US007900303B2

(12) United States Patent
Mastrosimone-Gese

(10) Patent No.: US 7,900,303 B2
(45) Date of Patent: Mar. 8, 2011

(54) NURSING PILLOW

(75) Inventor: Mary G. Mastrosimone-Gese, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/353,494

(22) Filed: Jan. 14, 2009

(65) Prior Publication Data

US 2010/0175194 A1 Jul. 15, 2010

(51) Int. Cl.
*A47G 9/10* (2006.01)

(52) U.S. Cl. ..... 5/655; 5/639; 5/645

(58) Field of Classification Search ..... 5/655, 639, 5/645, 636

See application file for complete search history.

(56) References Cited

U.S. PATENT DOCUMENTS

| | | | | | |
|---|---|---|---|---|---|
| D94,702 | S | | 2/1935 | Marks | |
| 4,060,863 | A | | 12/1977 | Craig | |
| 4,154,323 | A | * | 5/1979 | Sneider | 190/2 |
| 4,590,633 | A | * | 5/1986 | Pickens | 5/482 |
| 4,617,691 | A | * | 10/1986 | Monti et al. | 5/640 |
| 4,731,890 | A | * | 3/1988 | Roberts | 5/655 |
| 4,754,512 | A | | 7/1988 | Chao-Yang | |
| 4,914,765 | A | * | 4/1990 | Smith | 5/639 |
| 4,949,411 | A | * | 8/1990 | Tesch | 5/636 |
| 5,046,980 | A | * | 9/1991 | Tai et al. | 446/73 |
| 5,084,930 | A | | 2/1992 | Danova | |
| 5,261,134 | A | | 11/1993 | Matthews | |
| 5,430,902 | A | | 7/1995 | Lewis | |
| 5,519,906 | A | | 5/1996 | Fanto-Chan | |
| 5,551,108 | A | | 9/1996 | Butler, III | |
| 5,661,861 | A | | 9/1997 | Matthews | |
| 5,790,999 | A | | 8/1998 | Clark | |
| 5,920,931 | A | | 7/1999 | Zuehlke et al. | |
| 5,987,674 | A | | 11/1999 | Schaffner et al. | |
| 6,029,296 | A | * | 2/2000 | Terrell | 5/639 |
| 6,038,720 | A | | 3/2000 | Matthews et al. | |
| 6,061,854 | A | | 5/2000 | Crowley | |
| 6,279,185 | B1 | | 8/2001 | Matthews | |
| D450,517 | S | | 11/2001 | Darling et al. | |
| 6,412,128 | B1 | | 7/2002 | Matthews | |
| 6,434,770 | B2 | | 8/2002 | Brown | |

(Continued)

FOREIGN PATENT DOCUMENTS

JP 2006-192242 A 7/2006

OTHER PUBLICATIONS

PCT Search Report and Written Opinion for PCT/US2010/020593, May 26, 2010, 6 pages.

*Primary Examiner* — Robert G Santos
(74) *Attorney, Agent, or Firm* — Edell, Shapiro & Finnan, LLC

(57) ABSTRACT

A prenatal/postnatal pillow is disclosed. The pillow includes a body with a first end, a medial portion, and a second end. The pillow may possess a generally C-shaped structure defining an interior well operable to curve around a body part of a user. The interior of the pillow body defines a cavity, which may include a series of cells containing a predetermined amount of fill material. The ends of the pillow body may include fasteners that connect to draw the ends of the pillow together, forming a compact support surface. The pillow also includes an internal compartment for storing articles such as blankets, bottles, etc.

20 Claims, 8 Drawing Sheets

U.S. PATENT DOCUMENTS 6,453,493 B1 9/2002 Matthews Brown
6,457,195 B1 * 10/2002 Holste ..... 5/636
6,499,164 B1 12/2002 Leach
6,499,165 B1 12/2002 Morgillo
6,523,200 B2 * 2/2003 Brown ..... 5/639
6,598,248 B1 7/2003 Ong
6,601,252 B1 8/2003 Leach
6,625,828 B2 9/2003 Matthews Brown
6,641,221 B1 * 11/2003 Kastlunger ..... 297/397
6,658,681 B2 12/2003 Britto et al.
6,711,770 B1 3/2004 Owens et al.
6,751,817 B1 6/2004 Leach
6,760,934 B1 7/2004 Leach
6,763,539 B1 7/2004 Bartley et al.
6,848,128 B2 2/2005 Verbovszky et al.
6,851,143 B2 2/2005 Matthews Brown
6,944,898 B2 9/2005 Matthews Brown et al.
7,000,273 B2 2/2006 Rivera-Wienhold et al.
7,000,274 B2 2/2006 Matthews Brown et al.
7,017,212 B2 3/2006 Brown
7,055,196 B2 6/2006 Littlehorn
7,089,617 B1 8/2006 Lauro
7,089,639 B2 8/2006 Brown et al.
7,127,760 B2 10/2006 Bartley et al.
7,290,303 B2 11/2007 Mead et al.
7,331,073 B2 2/2008 Littlehorn et al.
7,404,222 B2 7/2008 Tidwell et al.
7,426,762 B2 9/2008 Dazzi
7,430,774 B2 10/2008 Littlehorn et al.
7,451,508 B2 11/2008 Brown et al.
7,540,049 B2 6/2009 Sklenarik et al.
7,562,406 B1 7/2009 Leach
7,587,773 B2 * 9/2009 Littlehorn et al. ..... 5/655
7,624,461 B2 12/2009 Tidwell et al.
7,669,265 B2 * 3/2010 Weise ..... 5/640
7,788,752 B2 9/2010 Tidwell et al.
2005/0210591 A1 9/2005 Mead et al.
2005/0278864 A1 12/2005 Leach
2006/0162080 A1 * 7/2006 Littlehorn et al. ..... 5/652
2007/0271703 A1 11/2007 Brown et al.
2008/0010750 A1 1/2008 Tidwell
2009/0000036 A1 1/2009 Littlehorn et al.
2009/0007335 A1 1/2009 Tidwell
2009/0094749 A1 4/2009 Littlehorn et al.
2009/0235459 A1 * 9/2009 Tidwell et al. ..... 5/640
2010/0175194 A1 * 7/2010 Mastrosimone-Gese ..... 5/639

* cited by examiner

NURSING PILLOW

FIELD OF THE INVENTION

The present invention is directed toward a nursing pillow and, in particular, to a curved pillow including an internal compartment for storing items, as well as a method of forming the pillow.

BACKGROUND OF THE INVENTION

Pillows are often used to support users in a comfortable position. Most pillow designs are not reconfigurable, failing to accommodate people of different sizes and shapes or to accommodate its use in diverse positions or modes of use. In addition, pillows lack storage space, requiring the user to either fasten related or accessory items directly to the pillow or risk losing the item. Thus, it is desirable to provide a nursing pillow capable of storing items within reach of the user.

SUMMARY OF THE INVENTION

A prenatal/postnatal pillow is disclosed. The pillow includes a body with a first end, a medial portion, and a second end. The pillow may possess a generally C-shaped structure defining an interior well operable to curve around a body part of a user. The interior of the pillow body may define a cavity, which may include a series of cells containing predetermined amounts of fill material. The ends of the pillow body may include fasteners that may be connected together to draw the ends of the pillow together, forming a more compact support surface. The pillow may also include an internal compartment for storing accessory items such as blankets, bottles, etc.

BRIEF DESCRIPTION OF THE DRAWINGS

Like reference numerals have been used to identify like elements throughout this disclosure.

DETAILED DESCRIPTION OF THE INVENTION

Figure 1:
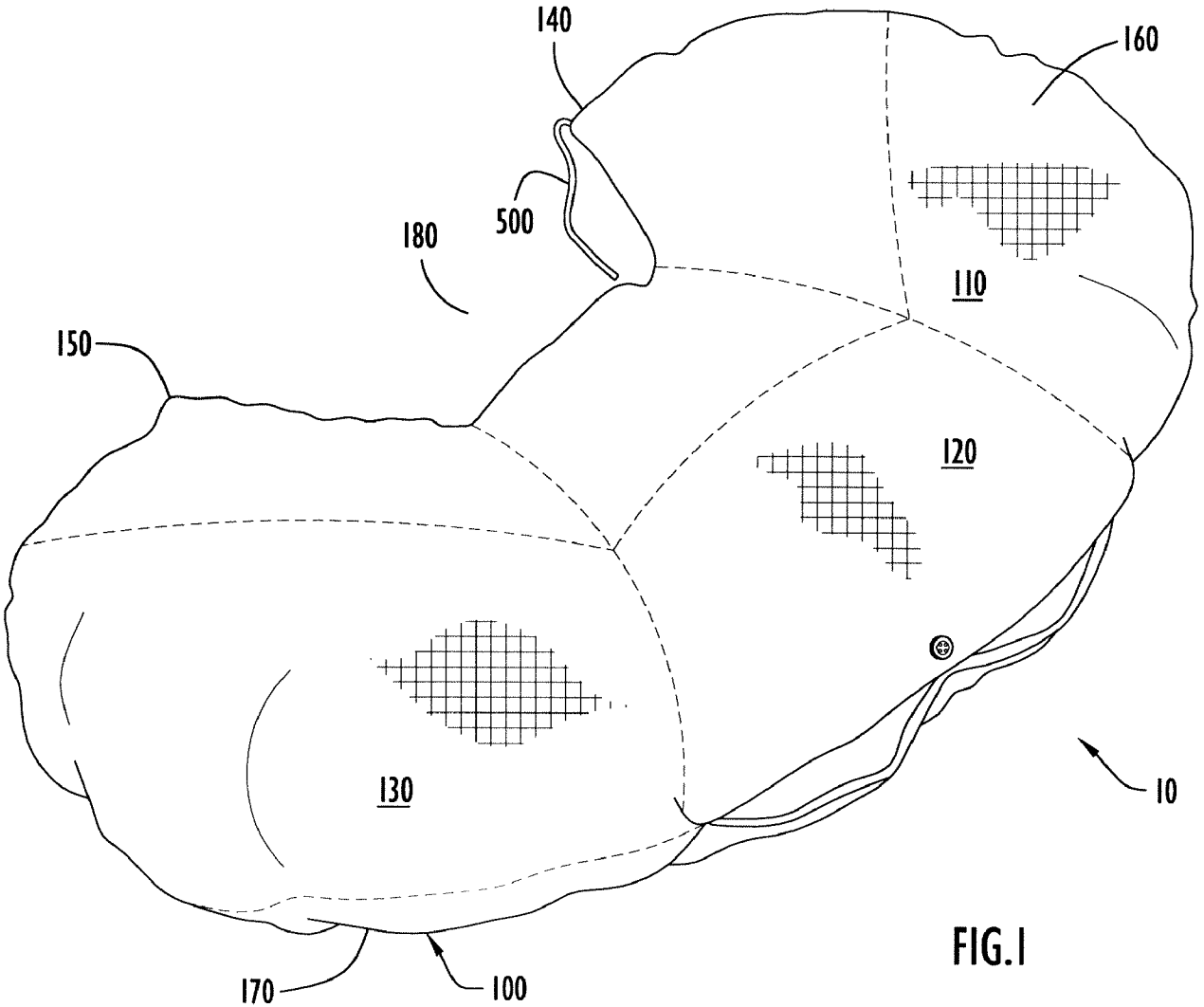
FIG. 1 illustrates a front perspective view of a support pillow in accordance with an embodiment of the present invention.

FIG. 1 is a perspective view of the support pillow in accordance with an embodiment of the present invention. As shown, the support pillow 10 includes a pillow body or shell 100 with a first portion 110, a second or medial portion 120, and a third portion 130. The first portion 110 terminates in a first end 140, while the third portion 130 terminates in a second end 150. The medial portion 120 is interposed between the first portion 110 and the second portion 130. The support pillow body 100 further includes a top surface 160 and a bottom surface 170. In the illustrated embodiment, the support pillow 10 possesses a generally curved, C-shaped or crescent-shaped configuration, wherein the curve of the support pillow forms a well 180 is capable of contouring around a body part of a user. For example, the well 180 may receive a user such that the support pillow 10 contours around the user's waist or torso. Preferably, the support pillow 10 is configured to wrap partially around a user (e.g., conforming to only the front half or the rear half of the user's waist). It is important to note, however, the support pillow body 100 may possess any dimensions and possess any shape suitable for its described purpose.

Figure 2A:
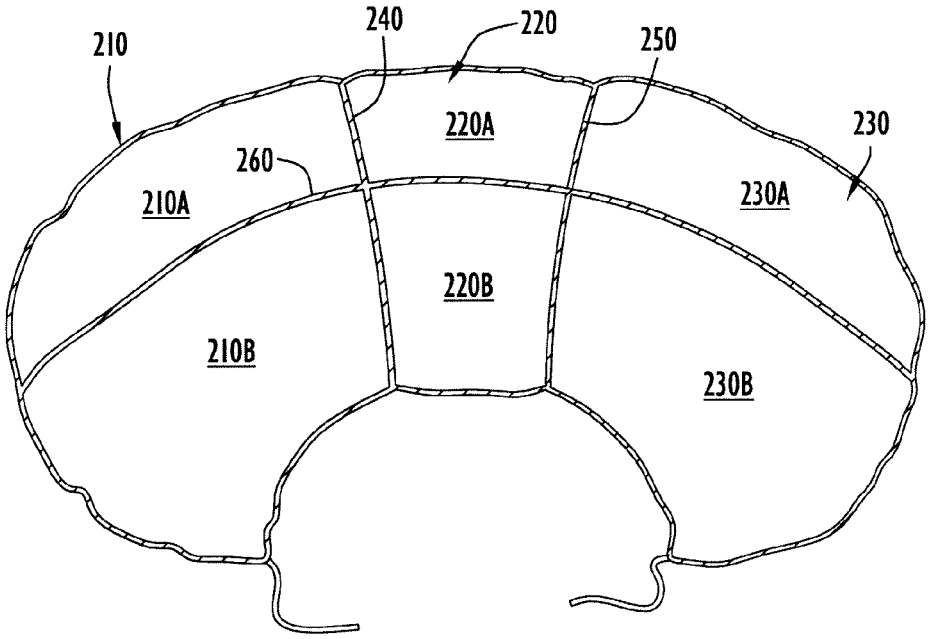
FIG. 2A is a top perspective view of the support pillow of FIG. 1, with the top portion of the pillow removed to show the pillow's internal cavity divided into cells.
Figure 2B:
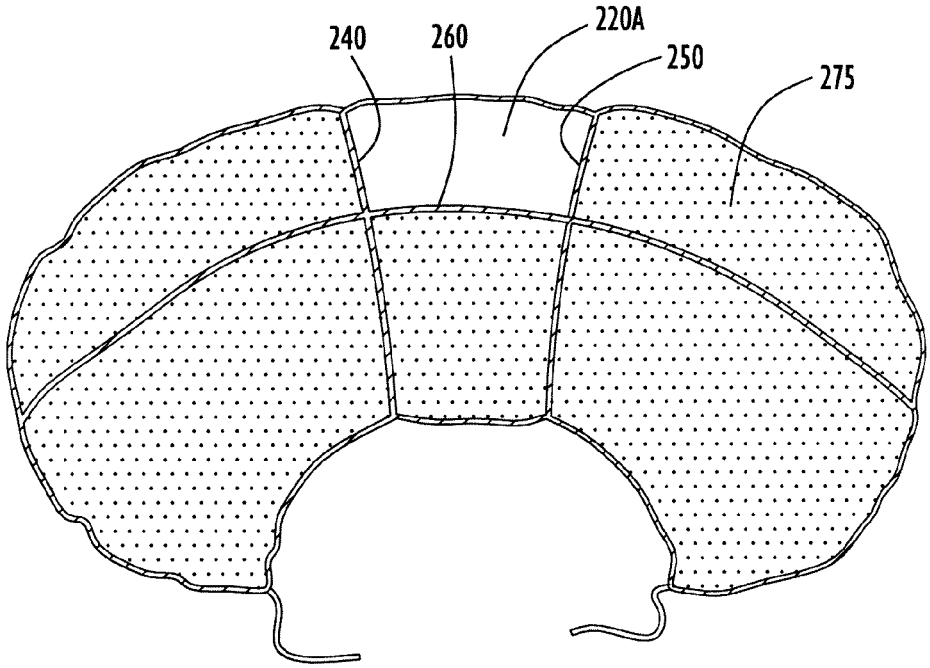
FIG. 2B illustrates the support pillow of FIG. 2A further including fill material within many of the cells.

FIGS. 2A and 2B are top views of the pillow of FIG. 1, with the top surface 160 of the pillow removed to reveal the internal pillow structure. As illustrated, the pillow body 100 is a shell (e.g., a fabric cover) with an internal cavity filled with a predetermined amount of fill material. The shell may define a single cavity; alternatively, the cavity may be segmented into sections. In the embodiment illustrated in FIGS. 2A and 2B, the cavity is divided into a first section 210, a second section 220, and a third section 230. The first section 210 is separated from the second section 220 by a first wall 240. Similarly, a second wall separates the second section 220 from the third section 230 by a second wall 250. The first cavity section 210 may correspond to the first body portion 110, the second cavity section 220 may correspond to the second body portion 120, and the third cavity section 230 may correspond to the third body portion 130. The walls made be formed from the same material as the shell (e.g., soft fabric), or may be formed from different material.

Each section 210, 220, 230, moreover, may be divided into subsections or cells. As shown in FIG. 2A, the cavity may include a third wall 260 beginning in the first section 210, extending through the second section 220, and terminating in the third section 230. With this configuration, a plurality of subsections or cells 210A, 210B, 220A, 220B, 230A, 230B a formed. As best seen in FIG. 2B, each cell 210A, 210B, 220A, 220B, 230A, 230B may be selectively filled with a predetermined amount of fill material 275, enabling complete control of the level of support (fill density) throughout the pillow 10. For example, each cell 210A, 210B, 220A, 220B, 230A, 230B may have the same level of fill density or may have varying levels of fill density. Fill materials 275 may include, but are not limited to, resilient, hypoallergenic material such as polyester fibers.

Figure 3:
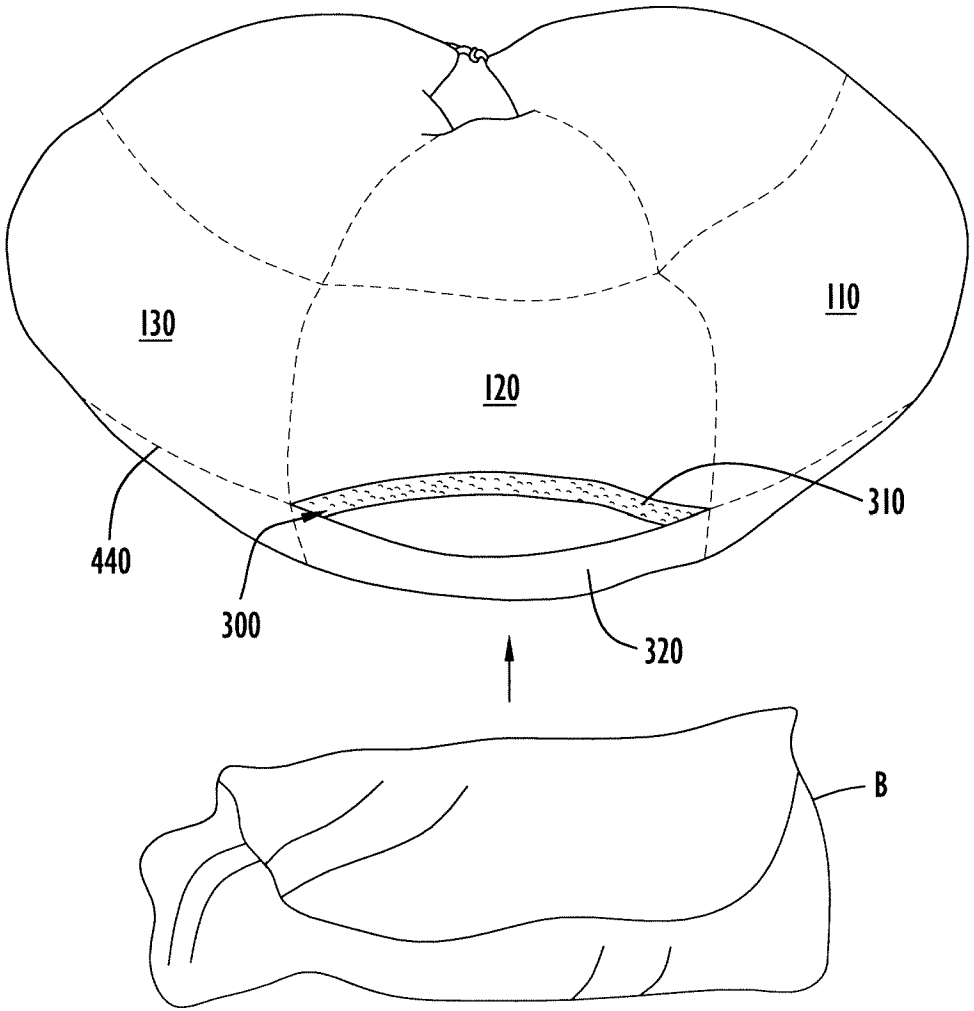
FIG. 3 is a front perspective view of the support pillow of FIG. 1, showing the internal storage compartment and an accessory for use therewith.

In addition, the pillow 10 may include at least one internal compartment operable to store objects such as blankets, toys, etc. As seen in FIG. 2B, cell 220A may not contain fill material 275 (or it may contain a reduced amount of fill material 275—just enough to maintain its shape). The first wall 240, the second wall 250, and third wall 260 define a pocket accessible to a user. FIG. 3 is a front perspective view of the pillow 10 of FIG. 1. As shown, the pocket is created within the medial portion 120 of the pillow body 100. Access to the pocket may be provided via an opening 300 disposed proximate the center of medial portion (e.g., the opening may be generally coplanar with the horizontal midplane (see 440) of the pillow body 100). The pocket may be sealed to secure objects therein. By way of example, the opening 300 may be formed from an upper flap 310 and lower flap 320 releasably connected using a hook and loop fastener (seen inf FIG. 3). Alternatively, other connection members (buttons (seen in FIG. 1), hooks, snaps, ties, zipper etc.) may be used. With this configuration, an internal compartment is formed (220A), permitting a user to safely secure items (e.g., a blanket B) within the compartment, out of reach from an infant. The pocket of cell 220A, furthermore, may include an internal fastener permanently or releasably connected to the item stored therein. For example, the blanket B may be tethered to the pocket, securing the blanket B to the pillow 10.

Figure 4:
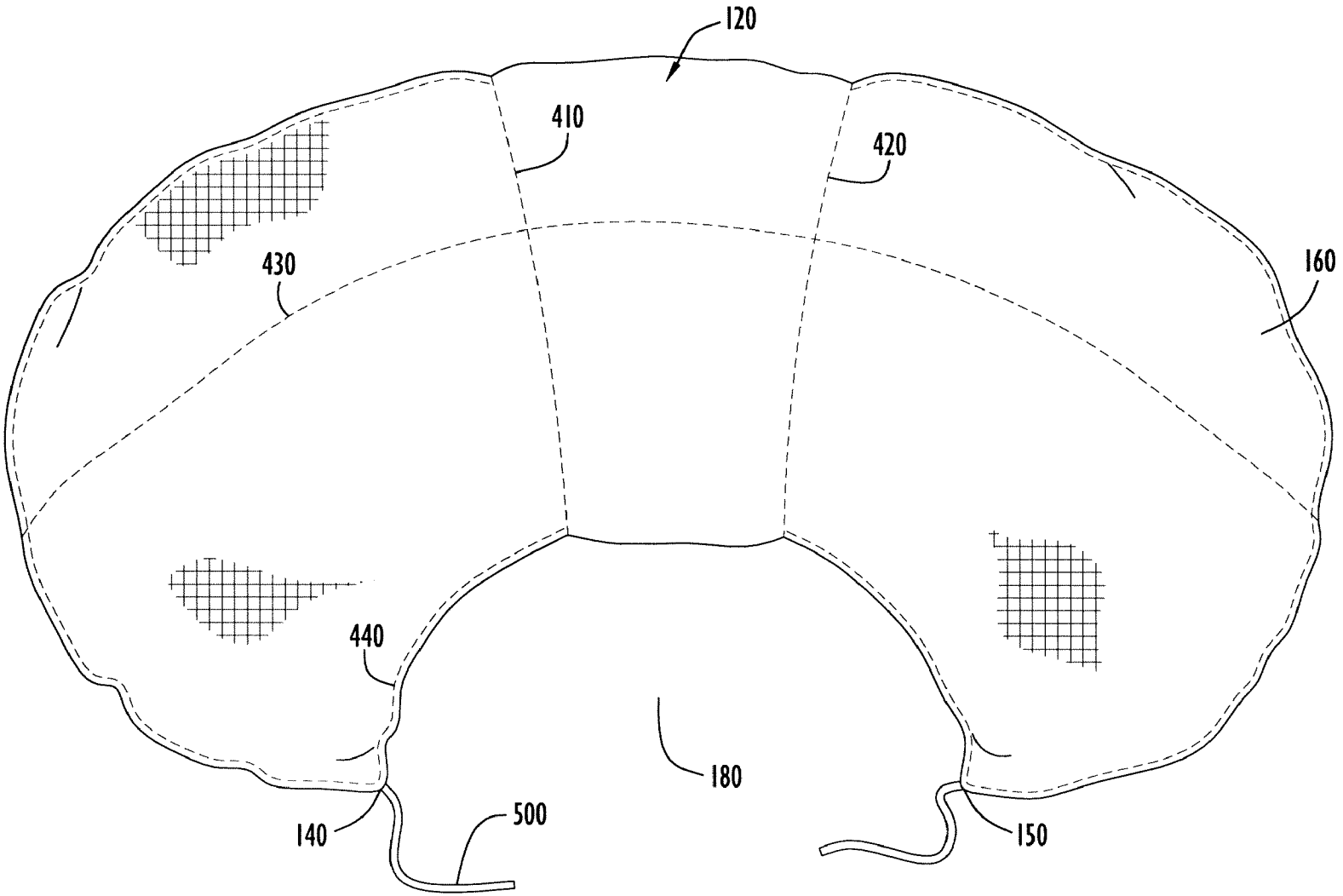
FIG. 4 illustrates a top plan view of the support pillow of FIG. 1, showing the seams of the pillow.

A plurality of seams may be formed in the pillow body 100 at predetermined locations to provide the pillow 10 with a desired degree of flexibility and/or support. FIG. 4 is a top view of the pillow 10, showing a seam configuration in accordance with an embodiment of the invention. As shown, the pillow body 100 includes a first generally vertical seam 410 and a second generally vertical seam 420 (from the perspective of FIG. 4). The first vertical seam 410 may correspond to the position first cavity wall 240; similarly, the second vertical seam 420 may correspond to the position of second cavity wall 250. Similar seams may be formed on the bottom surface 170 of the pillow body 100. As such, the first 410 and second 420 generally vertical seams may collectively define the medial portion 120 of the pillow body 100.

The pillow body 100 may further include one or more horizontal seams. In the embodiment illustrated in FIG. 4, the pillow may include a generally horizontal seam 430 extending along the top surface 160 of the pillow body 100, intersecting both of the generally vertical seams 410, 420. Similarly, the bottom surface 170 of the pillow body may include generally horizontal seam 430 extending along its surface (not illustrated). The generally horizontal seams 430 may correspond to the position of the third cavity wall 260, described above.

The pillow 10 may further include a peripheral seam 440 operable to secure the top surface 160 to the bottom surface 170 of the pillow body. The peripheral seam 440 may extend about the periphery of the pillow body, being generally coplanar with the horizontal midplane of the pillow body 100. The peripheral seam 440 may be formed around the entire periphery of the pillow body 100; alternatively, the peripheral seam may extend along only a portion of the pillow body 100. For example, as illustrated in FIG. 4, the peripheral seam 440 begins proximate the first vertical seam 410, travels away from the well portion 180 of medial section 120, around the first end 140 and the second end 150, and terminates proximate the second vertical seam 420. In other words, the medial portion 120 may lack a peripheral seam on along the front and rear of the medial portion 120.

Figure 5:
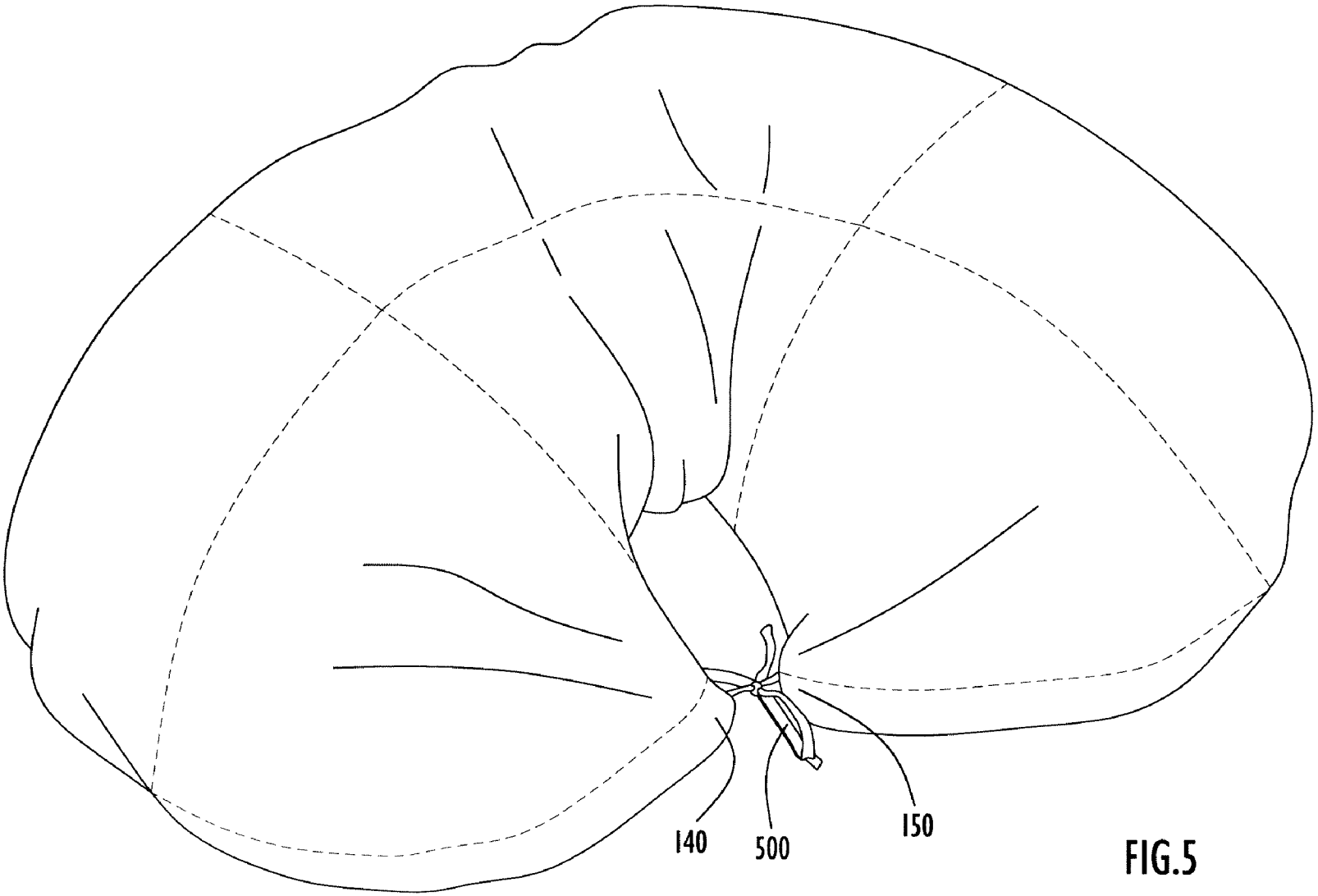
FIG. 5 illustrates the support pillow of FIG. 1 with its ends cinched into a closed-well configuration.

The pillow may further include connection members 500 operable to secure the first end 140 of the pillow body 100 to the second end 150 of the pillow body 100, creating a fuller support surface on which in infant may be supported. FIG. 5 illustrates a rear perspective view of the pillow, showing the operation of the connection members 500. In illustrated embodiment, the connection members 500 are straps tethered to each end 140, 150. The straps are tied together to draw the arms of the pillow inward, cinching the pillow ends 140, 150 together. With this configuration, the pillow 10 may be reconfigured from an open well configuration (FIG. 1) to a closed well configuration (FIG. 5). The closed well configuration creates a more compact, higher support surface onto which an infant may be placed (or onto which a user may rest her head). While straps are illustrated, other connection members 500 operable to secure to each other and secure the first end 140 of the pillow body to the second end 150 of the pillow body 100 (thus substantially closing the well 180) may be used, such as buttons, snaps, flaps, hook-and-loop fasteners, tie strings, belts etc. In addition to securing the ends 140, 150 of the same pillow together, the connection members 500 may be used to connect a plurality of pillows together, as well as be used to secure objects to the pillow such as infant toys, etc.

Figure 6:
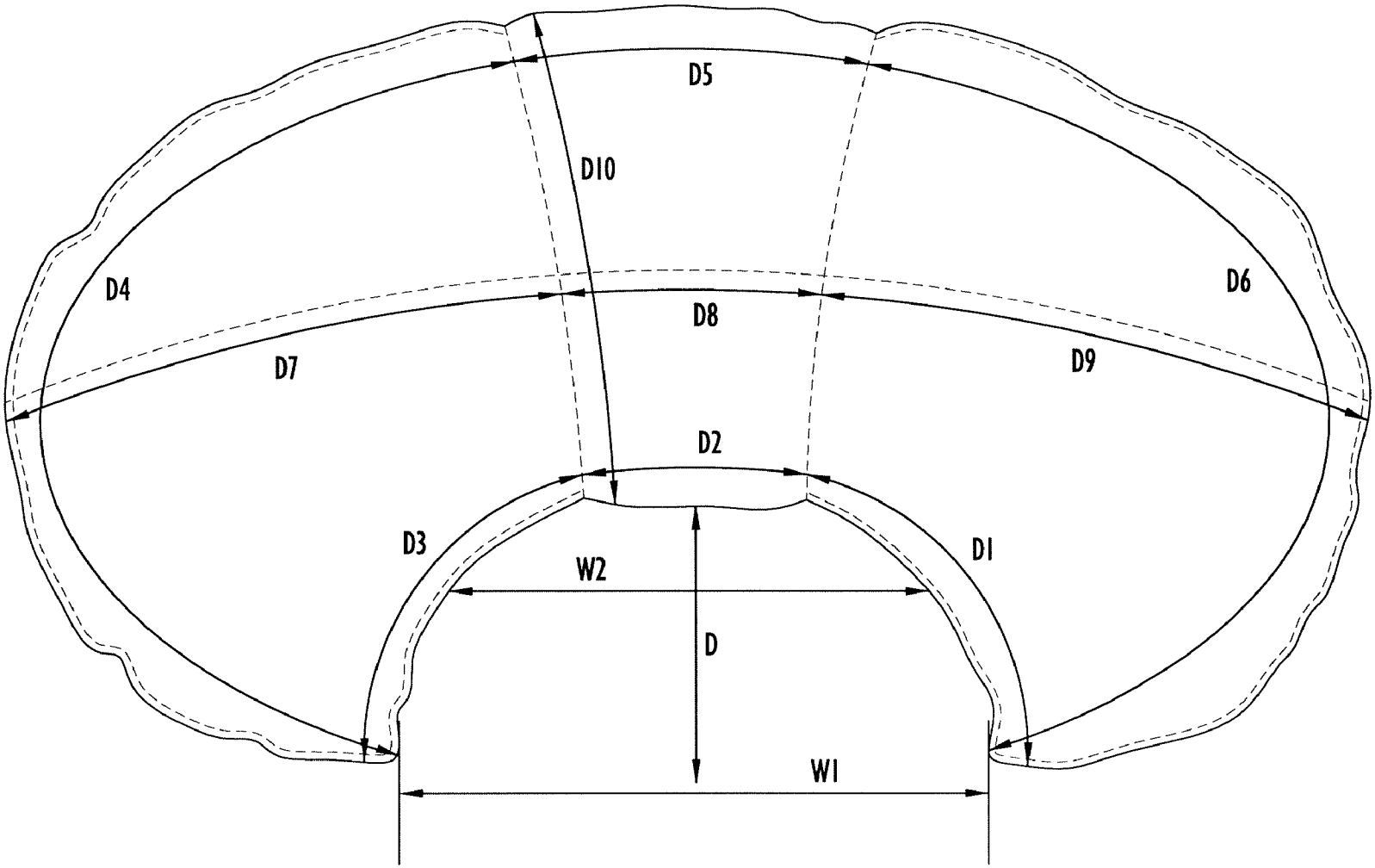
FIG. 6 illustrates a top plan view of the support pillow of FIG. 1, showing the exemplary dimensions of the pillow in accordance with an embodiment of the invention.

The dimensions of the pillow 10 may be defined to provide proper contour and support of a user. FIG. 6 is a top view of the pillow 10, showing specific examples of the various pillow dimensions that may be utilized. Starting with the rear side of the pillow (the side including the well 180), D, corresponding to the depth of the well 180, may be less than about 9 inches (22.86 cm). By way of example, D may possess a value of about 8 inches (20.32 cm). W1, corresponding to the width of the well 180 measured from first end 140 to second end 150, may be less than about 14 inches (35.56 cm) without stretching the arms apart. By way of example, W1 may possess a value of about 9-12 inches (22.86 cm-30.48 cm) without stretching the arms apart. W2, corresponding to the width of the well 180 measured proximate its midpoint, may be less than about 9 inches (22.86 cm). D1, corresponding to the distance from the second end 150 to the second generally vertical seam 420 (as measured along the peripheral seam 440), may be about 6.5 to about 10.5 inches (16.51 cm-26.67 cm). By way of example, D1 may possess a value of about 8.5 inches (21.59 cm). D2, corresponding to the distance from the second generally vertical seam 420 to the first generally vertical seam 410 (as measured along the peripheral seam 440) may be about 2-7 inches (5.08 cm-17.78 cm). By way of example, D2 may possess of value of about 5 inches (12.7 cm). D3, corresponding to the distance from the first generally vertical seam 410 to the first end 140 (as measured along the peripheral seam 440) may be about 6.5 to about 10.5 inches (16.51 cm-26.67 cm). By way of example, D3 may possess a value of about 8.5 inches (21.59 cm). Thus, the overall distance from the first end 140 to the second end 150 along the inner well may be about 15-28 inches (38.10 cm-71.12 cm). By way of example overall distance may be about 22 inches (55.88 cm).

Turning to the outer (front side) dimensions of the pillow 10, D4, corresponding to the distance from the first end 140 to the first generally vertical seam 410 (as measured along peripheral seam 440), may be about 26-30 inches (66.04 cm-76.20 cm). By way of example, D4 may possess a value of about 28 inches (71.12 cm). D5, corresponding to the distance from the first generally vertical seam 410 to the second generally vertical seam 420 (as measured along the peripheral seam 440) may be about 7-11 inches (17.78 cm-27.94 cm). By way of example, D5 may possess a value of about 9 inches (22.86 cm). D6, corresponding to the measurement from the second generally vertical seam 420 to the second end 150 (as measured along the peripheral seam 440), may possess a measurement similar to D4, thus may be about 26-30 inches (66.04 cm-76.20 cm). By way of example, D6 may possess a value of about 28 inches (71.12 cm). Thus, the overall outer dimensions of the pillow body 100 may be about 59-67 inches (149.86 cm-170.18). By way of example, the overall outer dimensions may be about 63 inches (160.02 cm).

D7, corresponding to the distance the generally horizontal seam 430 extends along the first portion 110 of the pillow 10, may be about 13-17 inches (33.02 cm-43.18 cm). By way of example, D7 may possess a value of about 15 inches (38.10 cm). D8, corresponding to the distance the generally horizontal seam 430 extends from the first generally vertical seam 410 to the second generally vertical seam 420, may be about 5.5-9.5 inches (13.97 cm-24.13 cm). By way of example, D8 may possess a value of about 7.5 inches (19.05 cm). D9, corresponding to the distance the generally horizontal seam 430 extends along the third portion 130 of the pillow 10, may be about 13-17 inches (33.02 cm-43.18 cm). By way of example, D9 may possess a value of about 15 inches (38.10 cm). Finally, D10, corresponding to the distance from the rear of the pillow 10 to the front of the pillow, as measured along the first or second generally vertical seam 410, 420, may be about 13-17 inches (33.02 cm-43.18 cm). By way of example, D10 may possess a value of about 15 inches (38.10 cm).

The height of the pillow 10 may taper from front of the pillow (the side including the pocket opening 300) towards the rear of the pillow. For example, the height of the pillow at the medial portion 120 may be about 5-11 inches (12.7 cm-27.94 cm) (e.g., about 7.5 inches (7.50 cm)), while the height measured at each end 140, 150, may be about 2-6 inches (5.08 cm-15.24 cm) (e.g., about 4 inches) (10.16 cm).

Figure 7:
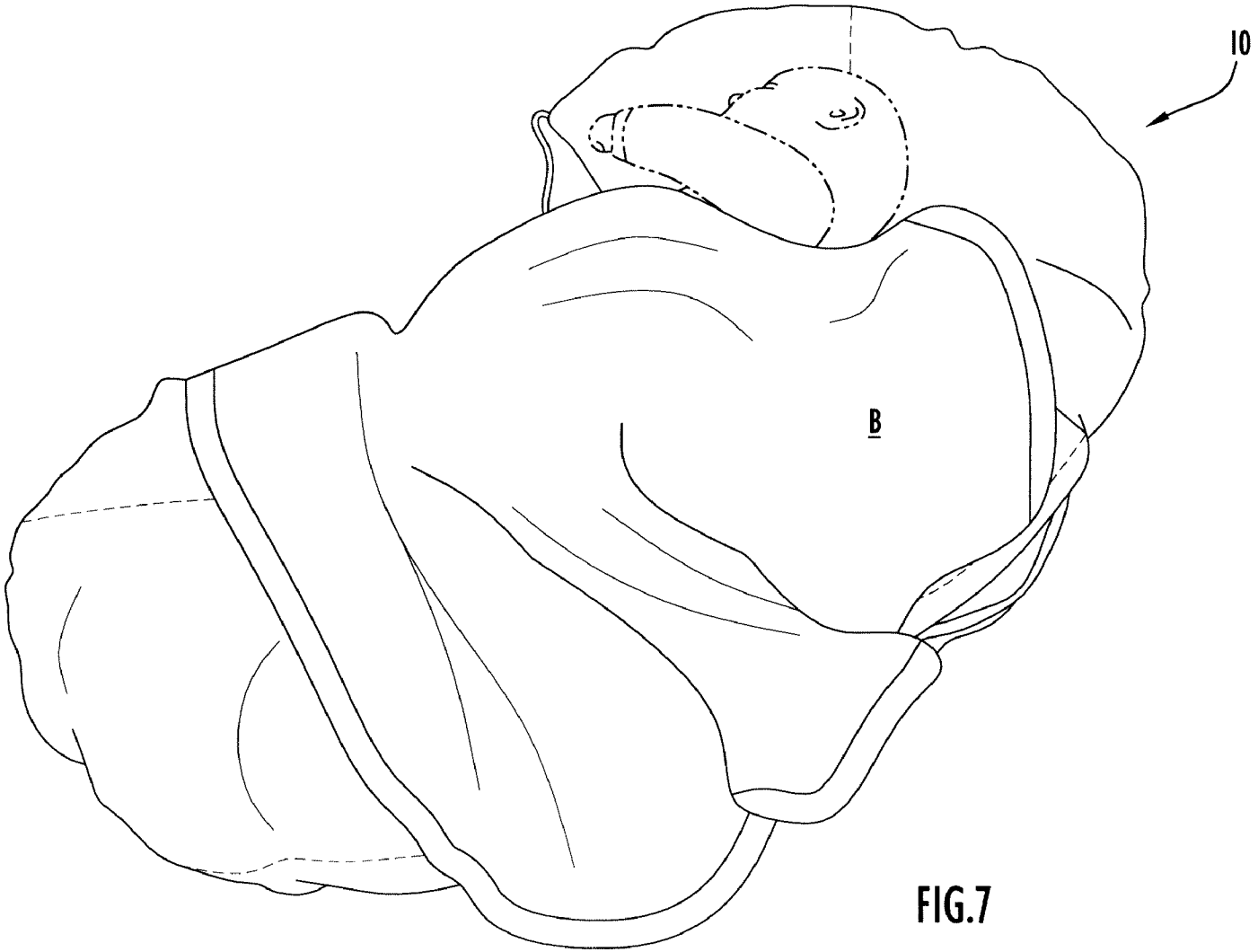
FIG. 7 illustrates the operation of the support pillow in a first mode, showing an infant sleeping on the support pillow of FIG. 1 (the infant being wrapped in the accessory—note that the user/parent is not shown for ease of illustration only).
Figure 8:
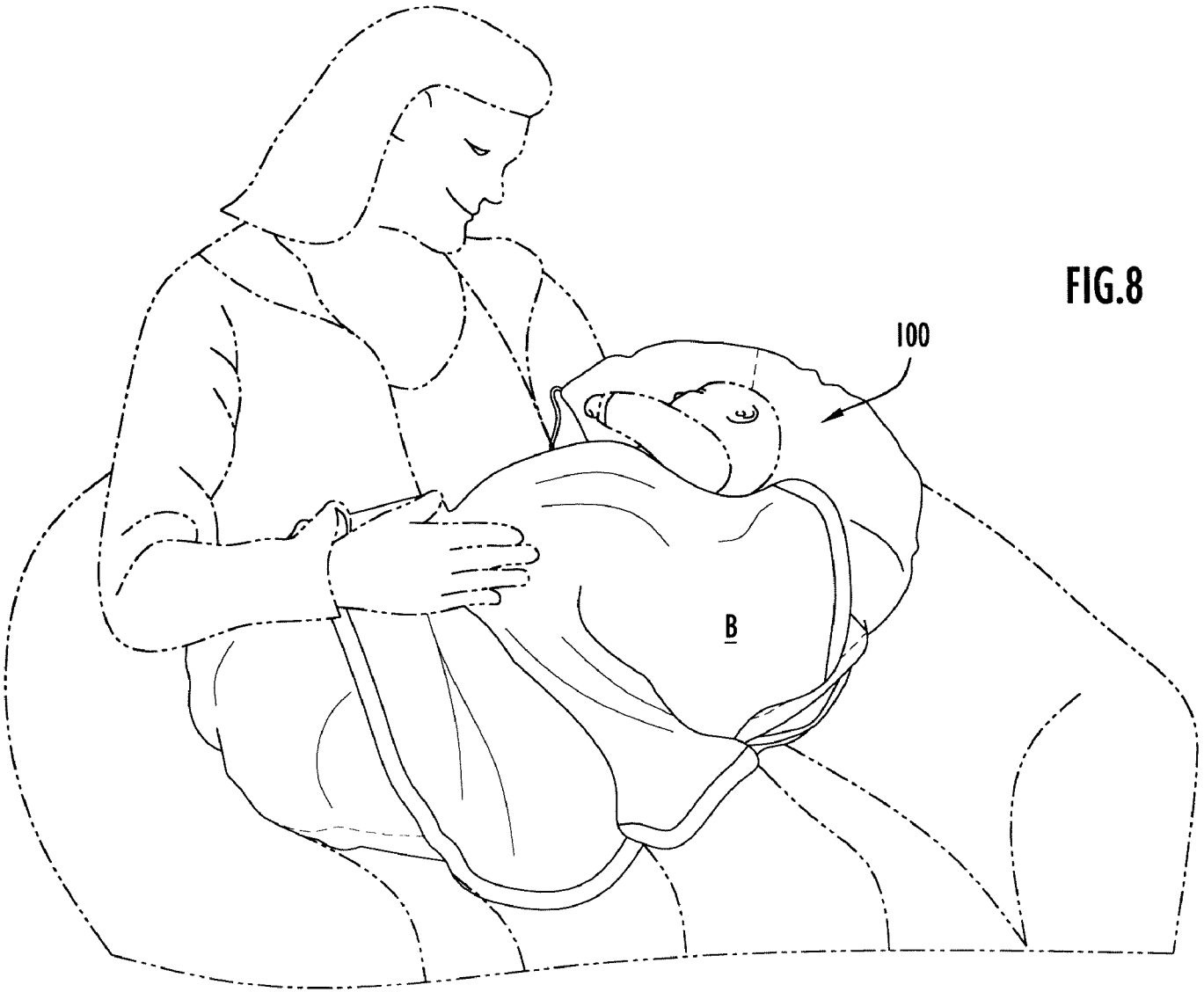
FIG. 8 illustrates the operation of the pillow of FIG. 1 in a second mode, showing a user supporting an infant while nursing.

FIG. 7 illustrates one exemplary use of the pillow 10 (where the user/parent is not shown for ease of illustration only—the infant should never be left unattended). As shown, in the first mode, an infant may be supported by the pillow 10. FIG. 8 illustrates the operation of the pillow of FIG. 1 in a second mode. In this second mode, the pillow 100 is partially wrapped around the waist of a user, with the medial portion 120 positioned over the user's lap. An infant may be positioned on the pillow for feeding, nursing, sleeping, etc.

The pillow 10 may be formed using processes such a blow filling. Specifically, the perimeter of the pillow 10 may be nearly entirely sealed, leaving a small opening through which batting material may be inserted. The batting material (e.g., polyester fiber) is blown into the cavity of the pillow until the pillow is filled to the desirable size and firmness. In operation, the individual cells may each be filled separately (and with differing amounts and densities of filling), after which the perimeter of the pillow body 100 is sealed (e.g., via stitching).

While the invention has been described in detail and with reference to specific embodiments thereof, it will be apparent to one skilled in the art that various changes and modifications can be made therein without departing from the spirit and scope thereof. For example, the pillow 10 can be of any size and shape, and may be formed from any suitable materials. The height of the pillow may taper downward from the medial portion toward the ends 140, 150; alternately, the height may remain constant, or may taper upward from the medial portion toward the ends 140, 150. Any number of seams may be used; moreover, the seams may be placed at any desired location. It is important to note, however, that the seams, 410, 420, 430 may be formed so they do not correspond with the walls of the cavity 205. In addition, fewer or greater amounts of seams may be provided. The pocket (i.e., a pocket opening 300) may be created within any portion 110, 120, and 130 of the body. In addition, multiple pockets may be formed within the body 100. Finally, the pillow 10 can include various external, removable, pillowcases, including pillowcases that incorporate a fashion design. The pillowcases may be machine washable and/or hypoallergenic.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. A nursing pillow adapted to wrap around a portion of a user's waist, the pillow comprising:

a generally C-shaped body including a first portion, a second portion, and a curved medial portion disposed between the first and second portions;

a shell defining a perimeter of the body; and a first interior compartment operable to house an article, wherein the interior compartment defines a cavity and includes an access opening formed into the shell, and wherein the interior compartment is selectively accessible via the access opening to enable a user to selectively insert an article into or remove an article from the interior compartment, a second interior compartment separated from the first interior compartment by a first interior wall; and a third interior compartment separated from at least one of the first interior compartment and the second interior compartment by a second interior wall, wherein the second compartment includes a first amount of fill material and the third compartment includes a second, different amount of fill material.

2. The pillow of claim 1, wherein at least one of the interior compartments is disposed within the medial portion.

3. The pillow of claim 1, wherein the access opening is formed proximate a horizontal midplane of the body.

4. The pillow of claim 1, wherein the access opening comprises a first flap and a second flap that define an elongated opening.

5. The pillow of claim 1, wherein the access opening comprises a fastener operable to selectively secure the access opening in a closed position and prevent the escape of any objects housed within the first interior compartment.

6. The pillow of claim 1, wherein the first interior compartment is operable to store an article selected from the group consisting of a blanket, a toy, and an infant accessory.

7. The pillow of claim 1, wherein the first interior compartment further includes a connector operable to secure the article to the interior compartment.

8. A nursing pillow comprising:

a body defining a generally C-shaped structure, the body including:

a first arm, a second arm, and a medial portion disposed between the first arm and the second arm, wherein the arms and the medial portion cooperate to define a well;

a shell defining a perimeter of the body;

a plurality of compartments within the body, the plurality of compartments including a first interior compartment separated from a second interior compartment by a wall; and a fastener disposed on a distal end of each arm, wherein the pillow operates in first mode, in which the fasteners are not secured to each other and the well is an open well operable to receive a body portion of a user, and in a second mode, in which the fasteners are connected, drawing the arms inward and substantially closing the well.

9. The nursing pillow of claim 8, wherein the wall comprises a first wall that generally bisects the pillow body.

10. The nursing pillow of claim 9, wherein the pillow further includes a second wall intersecting the first wall to form a third interior compartment and a fourth interior compartment within the pillow.

11. The nursing pillow of claim 10, wherein:

the third interior compartment includes fill material;

the fourth interior compartment defines a storage area that houses an article; and the pillow body further includes an access opening in communication with the fourth compartment.

12. The nursing pillow of claim 10 further comprising a third wall intersecting the first wall and disposed between the medial portion and the second arm.

13. The nursing pillow of claim 11, wherein the article is connected to the fourth interior compartment via a fastener.

14. The nursing pillow of claim 8, wherein each of the plurality of compartments contains a predetermined amount of fill material that provides each compartment with a predetermined fill density value.

15. The nursing pillow of claim 14, wherein each compartment has the same fill density.

16. The nursing pillow of claim 14, wherein the fill density varies among the compartments.

17. The nursing pillow of claim 8, wherein the height of the pillow tapers from the medial portion toward a distal end of an arm.

18. A method of forming a nursing pillow having a generally C-shaped structure, the method comprising:

(a) forming a shell including a first portion, a curved medial portion, and a second portion, wherein the shell defines an internal cavity;

(b) disposing a first wall within the cavity between the medial portion and the first portion;

(c) disposing a second wall within the cavity between the medial portion and the second portion, wherein the walls create a first compartment located proximate the first portion, a second compartment located proximate the medial portion, and a third compartment located proximate the second portion; and (d) filling the first compartment with a first amount of fill material; and (e) filling the second compartment with a second, different amount of fill material.

19. The method of claim 18 further comprising filling the third compartment with a third amount of fill material.

20. The method of claim 19, wherein the fill material is fibrous.

* * * * *